US007452240B2

(12) United States Patent
Carter

(10) Patent No.: US 7,452,240 B2
(45) Date of Patent: Nov. 18, 2008

(54) DUAL-CLAMP FUSE BLOCK

(75) Inventor: Gary Keith Carter, Maricopa, AZ (US)

(73) Assignee: Mitek Corp., Inc., Phoenix, AZ (US)

( * ) Notice: Subject to any disclaimer, the term of this patent is extended or adjusted under 35 U.S.C. 154(b) by 0 days.

(21) Appl. No.: 11/459,014

(22) Filed: Jul. 20, 2006

(65) Prior Publication Data

US 2008/0020647 A1 Jan. 24, 2008

(51) Int. Cl.
*H01R 13/68* (2006.01)

(52) U.S. Cl. ..... 439/620.27; 439/798

(58) Field of Classification Search ..... 439/620.26, 439/620.27, 798

See application file for complete search history.

(56) References Cited

U.S. PATENT DOCUMENTS 4,221,455 A 9/1980 Cairns et al.
4,921,450 A 5/1990 Herbert
6,174,204 B1 1/2001 Boivin
6,309,253 B1 10/2001 Tsai
6,551,141 B2 4/2003 Liang
7,223,129 B1 * 5/2007 Lopez et al. ..... 439/709

* cited by examiner

*Primary Examiner*—Khiem Nguyen
(74) *Attorney, Agent, or Firm*—Keith L. Jenkins, LLC; Keith L. Jenkins

(57) ABSTRACT

A fuse block which provides for holding a plurality of fuses in parallel in order to reduce fuse block size and to maximize the surface area of electrical contact in order to reduce electrical resistance in the electrical contact. The block holds the fuse electrical contacts clamped in trapezoidal cavities in terminals.

A fuse block, comprising a first multi-fuse coupler to electrically and mechanically couple with one first electrical contact of each of a plurality of fuses, in a first single tightening operation; a second multi-fuse coupler to electrically and mechanically couple with one second electrical contact of each of such plurality of fuses, in a second single tightening operation; and a base sized, shaped, and arranged to maintain said a first multi-fuse coupler and said a second multi-fuse coupler in opposing, aligned, and spaced-apart relationship.

20 Claims, 8 Drawing Sheets

DUAL-CLAMP FUSE BLOCK

FIELD OF THE INVENTION

The present invention relates to a fuse block using two smaller fuses in place of one larger fuse to save space. The present invention further relates to the use of the dual-clamp fuse block with other fuse block types.

BACKGROUND OF THE INVENTION

Fuse blocks, also known as "fuse boxes" and "fuse holders," are used in a wide variety of electrical applications to support electronic fuses that protect circuits from excess current. Fuse blocks generally comprise engaging mechanisms that each hold one electrical contact of a fuse and connect that fuse to an electrical conductor. Fuse blocks with multiple fuses and multiple contacts are known in the art.

Various designs of fuses are commercially available, including flat fuses also known as but not limited to ANL, AFS, MEGA, MIDI, CNL, CNN, etc. fuses. Flat fuses have flat electrical contacts extending externally from opposite ends of the fusible metal member inside the fuse body. The electrical contacts have slots adapted to receive screws for fastening the electrical contacts to a conductive coupler that leads to the external circuit that the fuse protects. A disadvantage of using screws or bolts to fasten flat fuses is that conduction of electrical current focuses on or near the screw body. Concentrating the current increases the temperature of the electrical contact and, therefore, its resistance to current flow. This shows up as a parasitic loss in the circuit. In systems that may operate in high-temperature environments, this added heat might be fatal to the circuit.

Another disadvantage of fuses in high-current applications is the physical size of the fuse. In automotive or automotive audio applications, for example, space is often at a premium. A large fuse generally requires a large fuse holder. A method for obtaining equivalent circuit protection in a smaller package is desired.

Yet another disadvantage of fuse blocks that impacts space usage is a lack of options for routing the input and output wires. Fuse blocks typically have one connection point to each end of the fuse. The connection point may be a bore in a solid block to which one electrical contact of the fuse is connected. The electrical conductor from the circuit is inserted into the bore and secured there by a clamp of some kind. The bore has a particular orientation in space, relative to the fuse, and the conductor may be of large diameter and, therefore, somewhat stiff over short lengths. If the electrical conductor is routed in from an inconvenient direction, a large loop may need to be made to bring the end around to align with the bore. This loop requires space that may not be available.

In many fuse block applications, a combination of different fuse sizes may be needed. A fuse block may also be used as a power distribution hub, in which one power input supplies a plurality of fuse-protected power outputs. Some fuse blocks use holders that require specialized tools for inserting and removing the fuse.

Hence, there is a need for a fuse block that minimizes space requirements. There is a further need for a compact fuse block that provides various fuse-protected outputs from a single input. There is yet a further need for a fuse block that provides options for input and output wire routing. There is yet another need for a fuse block that allows insertion and removal of fuses without special tools. Yet another need is for a fuse block that contacts both of the full flat faces of a flat fuse electrical contact to minimize current concentration and heat production.

BRIEF SUMMARY OF THE INVENTION

One embodiment of the present invention provides a fuse block for holding two fuses in parallel in place of a single, larger fuse. The electrically parallel fuses are secured using a hex-key-driver-operated clamp that secures two first electrical contacts of two fuses in one operation. The fuses may be inserted by hand, using minimal force. The fuses are protected from environmental influences by a snap-fit cover that requires no tools to attach or remove. A second embodiment of the present invention provides a fuse block for holding multiple fuses using a plurality of devices like the first embodiment. A third embodiment provides for the combination of the first embodiment with another type of fuse holder in a common fuse block. A fourth embodiment provides for input and output wire spatial orientation options.

BRIEF DESCRIPTION OF THE DRAWINGS

The above and other objects and advantages of the present invention will become more apparent from the following description taken in conjunction with the following drawings in which.

DETAILED DESCRIPTION OF THE DRAWINGS

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
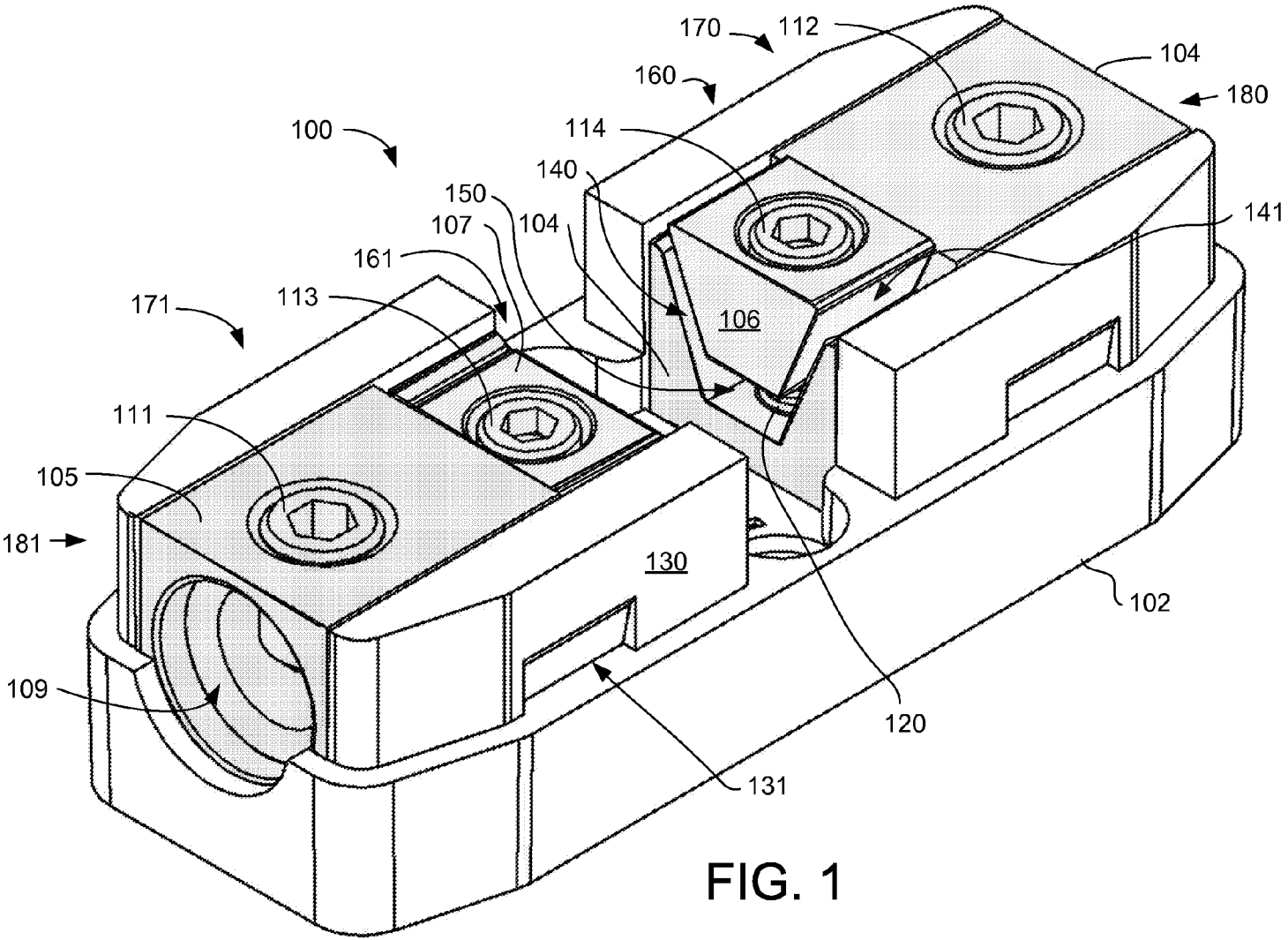
FIG. 1 is a top perspective view illustrating an exemplary embodiment of a dual-clamp fuse block.

FIG. 1 is a top perspective view illustrating an exemplary embodiment of a dual-clamp fuse block 100. The fuse block 100 illustrated in FIG. 1 is preferably bilaterally symmetrical about both principal horizontal axes. Fuse block 100 has a first terminal 104 that is preferably manufactured to the same design and dimensions as second terminal 105. Terminals 104 and 105 are made of an electrically conductive material, preferably metal. Terminal 104 has a cavity 150 in the end proximal to terminal 105. Terminal 105 has a cavity 150 (not visible in this view) in the end proximal to terminal 104. The cavity 150 is preferably shaped as an inverse trapezoid, as shown. The two terminals 104 and 105 are maintained in opposed, aligned, and spaced-apart orientation by base 102. Base 102 may include one or more shoulders 130 and one or more detents 131. The end of terminal 105 distal from terminal 104 has a bore 109 for receiving an electrical conductor from a circuit to be protected by fuses. Securer 111, illustrated here as a setscrew, is sized and arranged to intrude transversely into bore 109 in order to secure an electrical conductor inserted in bore 109. Securer 112 serves an identical function for a bore (not visible in this view) in terminal 104. Securer 111 and bore 109 in terminal 105 form a conductor coupler 181. Securer 112 and the bore in terminal 104 form a conductor coupler 180. Those skilled in the art, upon reading the teachings of this specification, will appreciate that, under appropriate circumstances, considering such issues as the type of conductor to be coupled, the type of fuse to be secured, the operational environment, ergonomics, and customer preferences, other conductor couplers 180 and 181, such as solder fittings, clamps, broad-headed screws, etc., may suffice.

Block 106 fits into cavity 150 and is preferably biased outward from the cavity 150 by a biasing mechanism 120, illustrated here as a coil spring. Urging mechanism 114, illustrated here as a cap screw, may be used to urge block 106 into cavity 150 against the force of the biasing mechanism 120. Urging mechanism 114 may be operated in reverse to allow biasing mechanism 120 to bias block 106 further outward from cavity 150. The motion of block 106 changes the size of gap 140 and of gap 141 in a single operation of the urging mechanism 114. Gap 140 and gap 141 may be adjusted by urging mechanism 114 to be wide enough to receive the first electrical contacts 251 (see FIG. 2) of first and second flat fuses 250 and may then be made small enough to secure the first electrical contact 251 of a first flat fuse 250 in gap 140 and the first electrical contact 251 of a second flat fuse 250 in gap 141. Block 107 is similarly positioned by urging mechanism 113 relative to its cavity 150 (not visible in this view) in terminal 105. Second contacts 253 of those flat fuses 250 whose first contacts 251 are clamped in gaps 140 and 141 are similarly secured by their second contacts 253 between block 107 and terminal 105. Those skilled in the art, upon reading the teachings of this specification, will appreciate that, under appropriate circumstances, considering such issues as the type of conductor to be coupled, the type of fuse to be secured, the operational environment, ergonomics, and customer preferences, other urging mechanisms, such as screw-jacks, cams, rack and pinion arrangements, other clamps, etc., may suffice.

Block 106 is preferably an inverted trapezoidal solid made of rigid material. In alternate embodiments adapted to different types of fuses, the shape of the block 106 and the cavity 150 may be altered to adapt to the shape of the fuse and its electrical contacts. The spacing between multi-fuse couplers may also be adapted, in particular embodiments, to fuse types. In other particular embodiments, the dual-clamp fuse block 100 has clamps adapted to clamp various types of fuses.

Block 106, together with urging mechanism 114 and biasing mechanism 120 comprise a clamp 160. Block 107, together with urging mechanism 113 and another biasing mechanism 120 (not shown in this view) comprise a clamp 161. Clamp 160, terminal 104, and conductor coupler 180 together form a multi-fuse coupler 170, illustrated here as a dual fuse coupler. Clamp 161, terminal 105, and securer 111 together form a multi-fuse coupler 171, illustrated here as a dual fuse coupler. Multi-fuse couplers 170 and 171, together with base 102 form dual-clamp fuse block 100. Those skilled in the art, upon reading the teachings of this specification, will appreciate that, under appropriate circumstances, considering such issues as the type of fuse to be held, the shape of the electrical contacts for the fuse, ergonomics, and customer preferences, other dual-clamping designs, such as those adapted to tube fuses, bayonet contact fuses, etc., are within the present invention.

Figure 2:
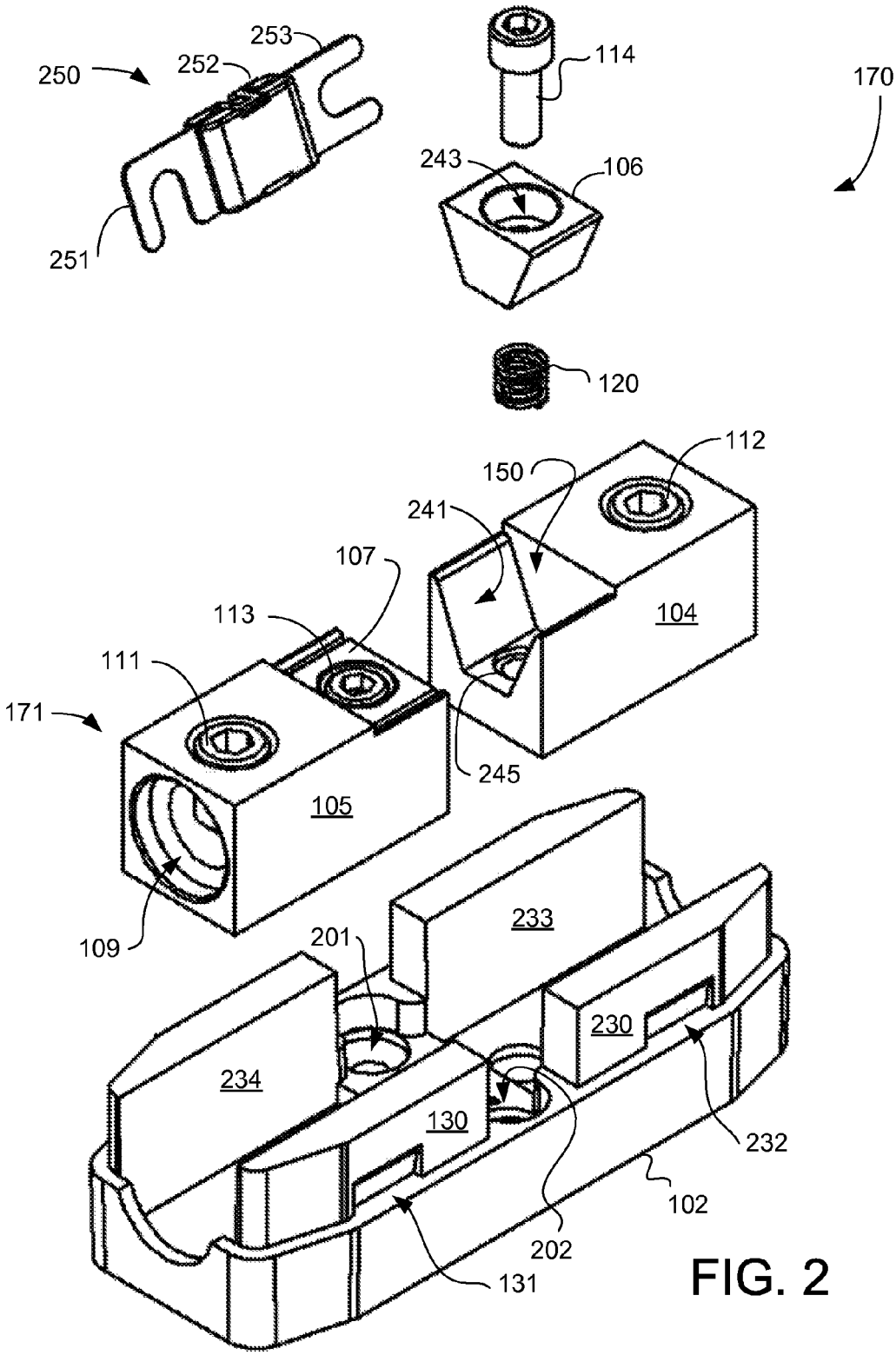
FIG. 2 is a top perspective view illustrating a partial assembly sequence of the exemplary embodiment of the dual-clamp fuse block of FIG. 1 showing a fuse.

FIG. 2 is a top perspective view illustrating a partial assembly sequence of the exemplary embodiment of the dual-clamp fuse block 100 of FIG. 1 and showing a flat fuse 250. Base 102 maintains the multi-fuse couplers 170 and 171 in opposed, spaced apart, aligned relationship. For the embodiment illustrated in FIG. 2, (for a flat fuse 250) the length of the space between terminals 104 and 105 is sized to accommodate the body 252 of flat fuse 250. Shoulders 130 and 234 are sized and arranged to receive multi-fuse coupler 171. Shoulders 230 and 233 are sized and arranged to receive multi-fuse coupler 170. Detents 131 and 232 are preferably on the exterior of each of the shoulders 130 and 234, as well as shoulders 230 and 233 (detents not visible in this view). Holes 201 and 202 are for receiving fasteners, such as screws, for mounting base 102 on an environmental surface. Those of skill in the art, upon reading this disclosure, will appreciate that base 102 may be positioned in an operational environment in any orientation: there is no preferred orientation. This feature improves space utilization.

Multi-fuse coupler 171 is illustrated as being based upon modified rectangular terminal 105. Those of skill in the art, upon reading this disclosure, will appreciate the variety of useful shapes that terminal 105 may have. For example, terminal 105 and terminal 104 could be made from circular-cylinder rod stock, with base 102 appropriately modified to adapt to that shape. Terminals 104 and 105 preferably have a low electrical resistance and are sized to carry a current load greater than or equal to the current load to be carried by fuses 250. In this embodiment for flat fuses, flat surface 241 in cavity 150 engages a large surface of electrical contact 253 of flat fuse 250. Biasing mechanism 120 is preferably a coil spring that can be held in place by and coaxial to urging mechanism 114. Urging mechanism 114 is inserted through bore 243, through biasing mechanism 120, and into threaded bore 245.

Figure 3A:
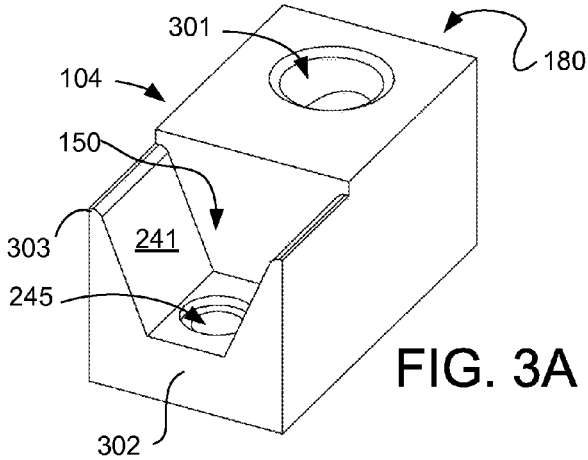
FIG. 3A is a top perspective view illustrating an exemplary embodiment of a terminal for the dual-clamp fuse block of FIG. 1.

FIG. 3A is a top perspective view illustrating an exemplary embodiment of a terminal 104 or 105 for the dual-clamp fuse block 100 of FIG. 1. Inverted trapezoidal cavity 150 has a bottom wall 302 that contains threaded bore 245. Inclined sidewall 241 preferably has a rounded top edge 303 to assist in insertion of fuse 250. Terminal 104 preferably has a threaded bore 301 for receiving a securer 112 for the conductor coupler 180.

Figure 3B:
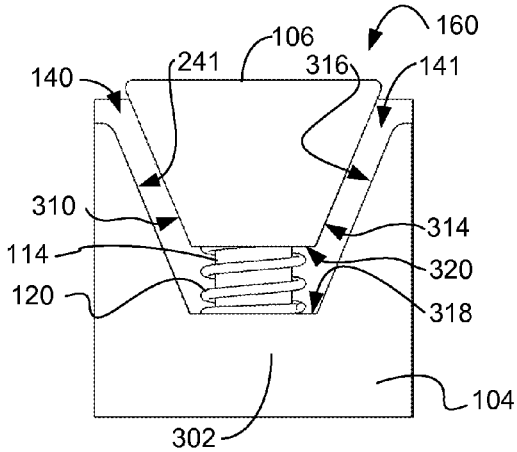
FIG. 3B is a front view illustrating an exemplary embodiment of a clamp for the dual-clamp fuse block of FIG. 1.

FIG. 3B is a front view illustrating an exemplary embodiment of a clamp 160 for the dual-clamp fuse block 100 of FIG. 1. Block 106 is biased upward (in this view) by biasing mechanism 120 and urged downward (in this view) by urging mechanism 114. Motion of clamp 160 out of the cavity 150 widens gaps 140 and 141 with a single operation. Gap 140 is between inclined sidewall 241 and side surface 310. Gap 141 is located between sidewall 316 and side surface 314. The clamp 160 is sized and arranged so that the gaps 140 and 141 can be made wide enough to allow sideways insertion of an electrical contact 251 or 253 of a flat fuse 250. Clamp 160 is also sized and arranged to adjust to mechanically and electrically engage the large surfaces of the inserted electrical contacts 251 or 253. Sidewalls 241 and 316, as well as side surfaces 310 and 314 are preferably sized to engage substantially the entire large surfaces of electrical contacts 251 or 253. The clamp 160 is preferably electrically conductive and electrically coupled to terminal 104 through electrically conductive urging mechanism 114 and electrically conductive biasing mechanism 120 to cavity bottom wall 302 of terminal 104. Accordingly, the multi-fuse coupler 170 operable to be in electrical contact with both large surfaces of the first contacts 253 from each of two flat fuses 250.

Biasing mechanism 120 is preferably located between block bottom surface 320 and cavity bottom surface 318. Those of skill in the art, upon reading this disclosure, will appreciate the variety of mechanisms that may be used as biasing mechanism 120. For examples, and without limitation, leaf spring, bow springs, disc springs, counterbalances, push rods, magnets, and cams may be used to bias block 106 outward from cavity 150. In some alternate embodiments, biasing mechanism 120 may be located above block 106. In some alternate embodiments, biasing mechanism 120 may be absent.

Figure 3C:
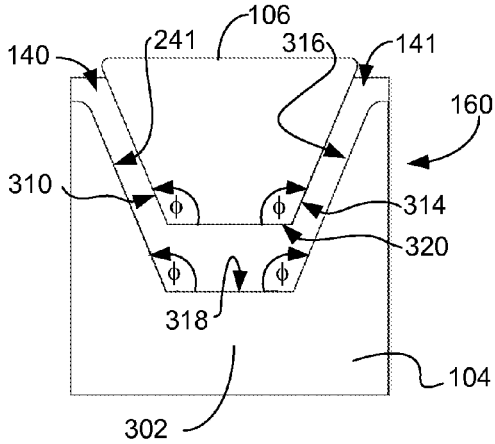
FIG. 3C is a front view illustrating further details of an exemplary embodiment of a clamp for the dual-clamp fuse block of FIG. 1.

FIG. 3C is a front view illustrating further details of an exemplary embodiment of a clamp 160 for the dual-clamp fuse block 100 of FIG. 1. The obtuse angles, $\phi$, of the trapezoidal block 106 are preferably equal to each other and are also preferably equal to the obtuse angles, $\phi$, of the trapezoidal cavity of terminal 104, as shown. Preferably, the angles $\phi$ are about 112.5°+/−15° and more preferably 112.5°. In some specially adapted embodiments, the tolerance may exceed the +/−15° limits. Some alternate embodiments may have angles $\phi$ that are only pair-wise equal on each side of block 106 and terminal 104.

Figure 3D:
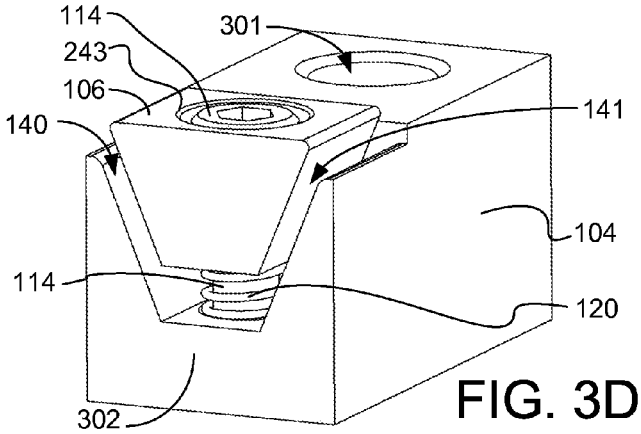
FIG. 3D is a front perspective view illustrating the exemplary embodiment of a clamp for the dual-clamp fuse block of FIG. 1.

FIG. 3D is a front perspective view illustrating the exemplary embodiment of a clamp 160 for the dual-clamp fuse block 100 of FIG. 1. The urging mechanism 114, illustrated here as a cap screw, may be clearly seen in this view as extending through bore 243 in block 106 and through biasing mechanism 120 into threaded bore 245. Gaps 140 and 141 depend for their width on the height of block 106 in cavity 150. By a single operation (for example, driving one cap screw) of urging mechanism 114, first ends 251 of two fuses 250 may be clamped into place in gaps 140 and 141. Those of skill in the art, upon reading this disclosure, will appreciate the wide variety of devices that may serve as urging mechanism 114. For examples, and without limitation, scissor-jacks, cam-and-follower arrangements, spring-loaded clamps, adjustable resilient support arms, etc., may serve as urging mechanism 120.

Figure 4:
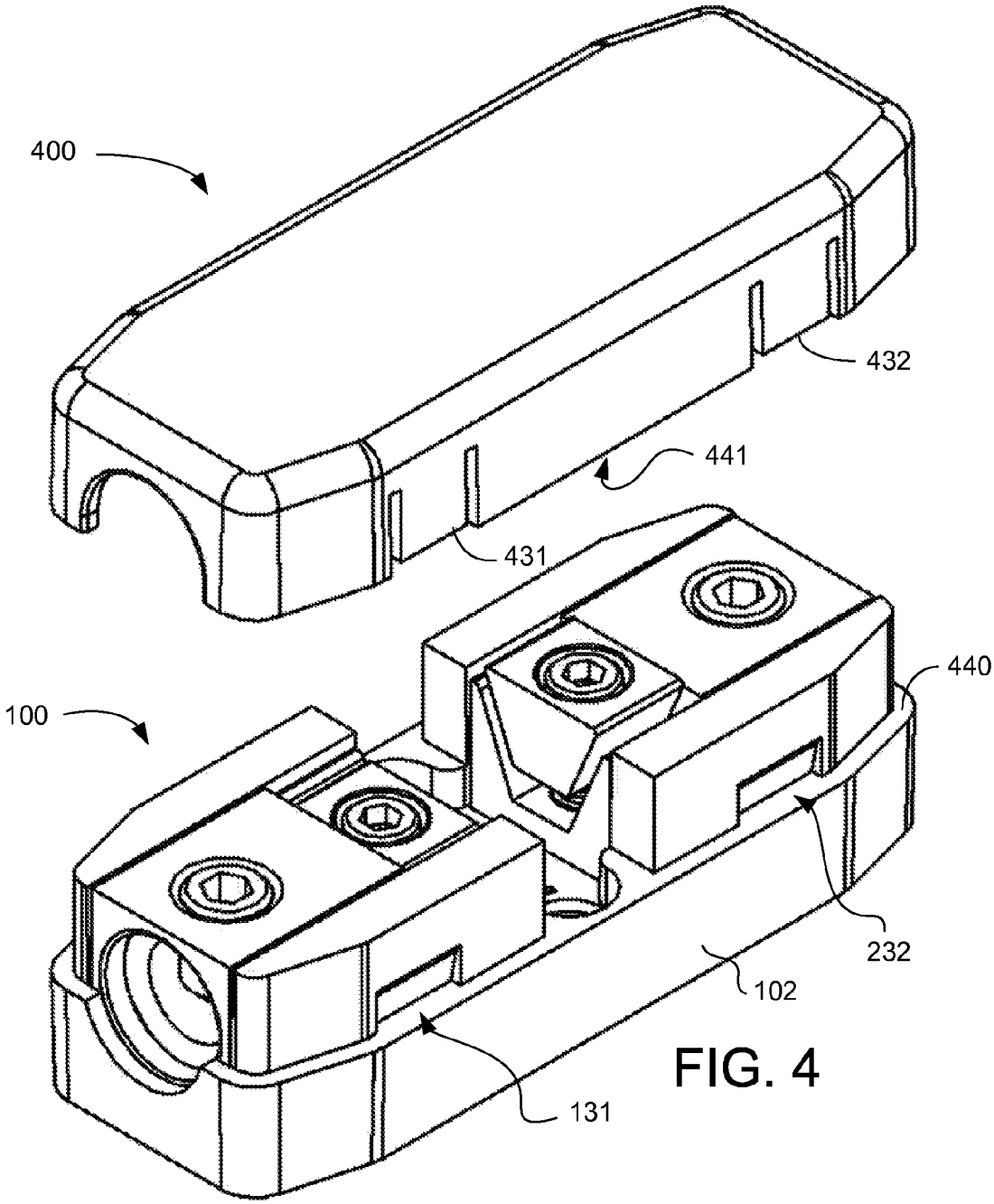
FIG. 4 is a top perspective view illustrating the exemplary embodiment of the dual-clamp fuse block of FIG. 1 with a cover.

FIG. 4 is a top perspective view illustrating the exemplary embodiment of the dual-clamp fuse block 100 of FIG. 1 with a cover 400. Cover 400 is sized, shaped and arranged to releasably snap-fit onto dual-clamp fuse block 100. Preferably, dual-clamp fuse block 100 (more preferably base 102) has a rim 440 arranged to support the lower edge 441 of cover 400. Cover 400 has resilient tabs 431 and 432 operable to snap-fit into detents 131 and 232 respectively. Additional detents are preferably symmetrically arranged on both sides of the dual-clamp fuse block 100 and additional resilient tabs are preferably symmetrically arranged on both sides of the cover 400. Preferably, the cover 400 is itself resilient and may be installed and released by hand and without tools. Cover 400 is preferably made of material that acts as electrical insulation, such as plastic. Cover 400 may be transparent, translucent, or opaque. In embodiments for use in severe environmental conditions, a watertight seal may cover rim 440 and additional watertight material may protect the openings 109, 201, 202, etc., into the covered volume. Cover 400 may be decorated, emblazoned with a trade dress or trademark, and inscribed with instructions for use.

Figure 5:
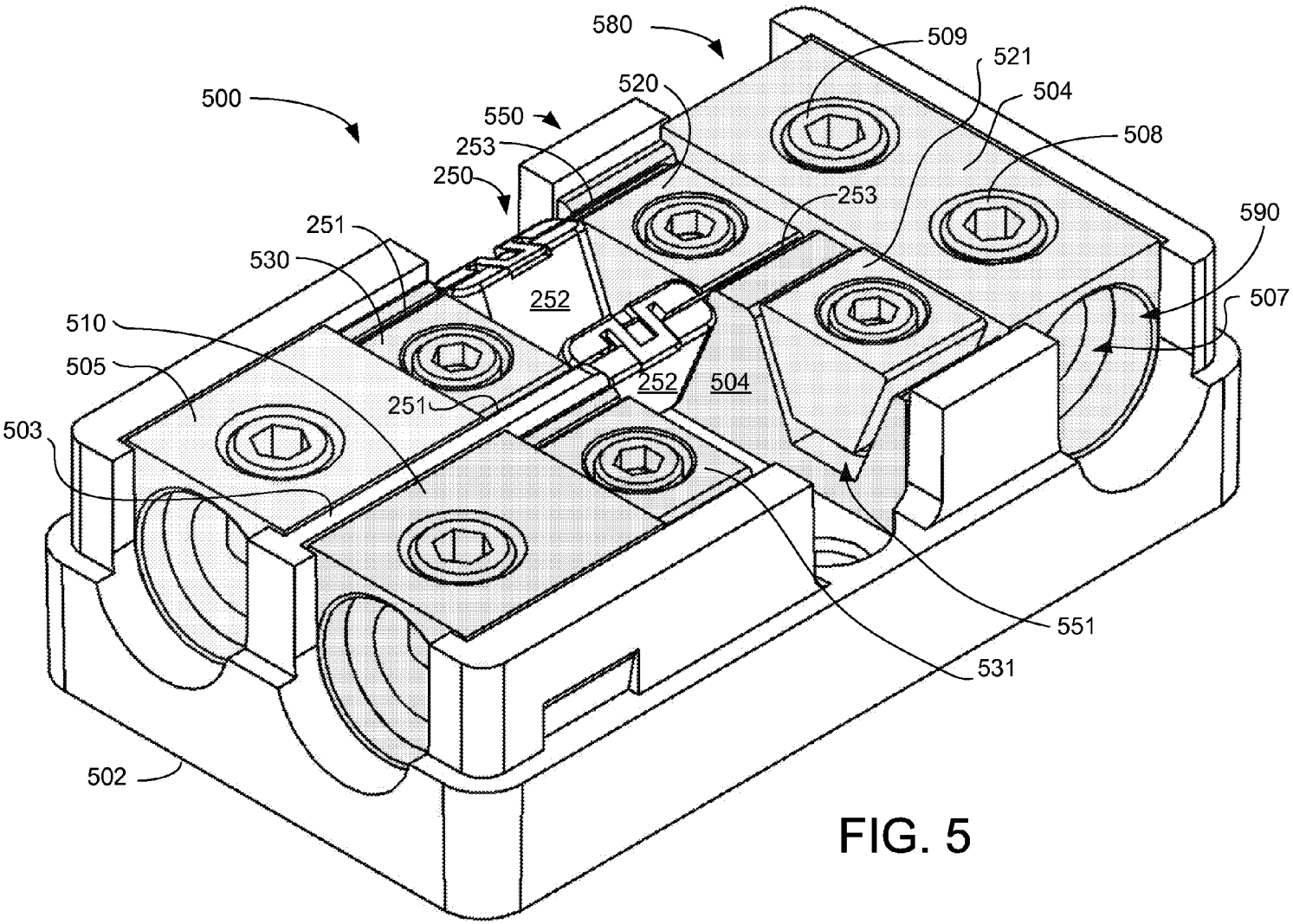
FIG. 5 is a top perspective view illustrating a second exemplary embodiment of the dual-clamp fuse block having two dual-clamp fuse holders, with fuses shown installed on one side.

FIG. 5 is a top perspective view illustrating a second exemplary embodiment of the dual-clamp fuse block 100 having two pairs of multi-fuse couplers, with two flat fuses 250 shown installed on one side. Preferably, fuse block 100 comprises fuse block 500. Electrically insulating base 502 supports multi-fuse couplers 505 and 510 at the output end (left, in the FIG. 5 view). An extended insulating fin 503 of base 502 separates multi-fuse couplers 505 and 510. The input end (right, in the FIG. 5 view), includes a single terminal 504 having two inverted trapezoidal cavities 550 and 551 and two clamps 520 and 521. Two flat fuses 250 are shown installed with clamps 530 and 520. First electrical contacts 251 of fuses 250 are clamped by clamp 530 and second electrical contacts 253 are clamped by clamp 520. The spacing between terminal 504 and terminal 505 accommodates fuse bodies 252. Terminal 504 has an electrical conductor coupler comprising bore 507 and securers 508 and 509. Preferably, bore 507 extends completely through terminal 504 and may be accessed from either side of the terminal. In an alternate embodiment, bore 507 extends less than half-way through terminal 504 and a second bore (not visible in this view), symmetrical with and aligned to bore 507, also extends less than half-way through terminal 504. Multi-fuse coupler 580 includes terminal 504, clamps 520 and 521, and electrical conductor coupler 590 formed by bore 507 and securers 508 and 509.

Multi-fuse coupler 510 and clamp 521 of multi-fuse coupler 580 are shown without fuses installed. Those of skill in the art will appreciate that, while the clamps 531 and 521 are designed to clamp two fuses 250 in a single operation, there will be circumstances where less than a full complement of fuses 250 are desired between particular multi-fuse couplers. Dual-clamp fuse block 500 is sized, shaped, and adapted to receive a cover (not shown) similar in properties to cover 400 but sized, shaped, and arranged to snap-fit to dual-clamp fuse block 500.

Figure 6:
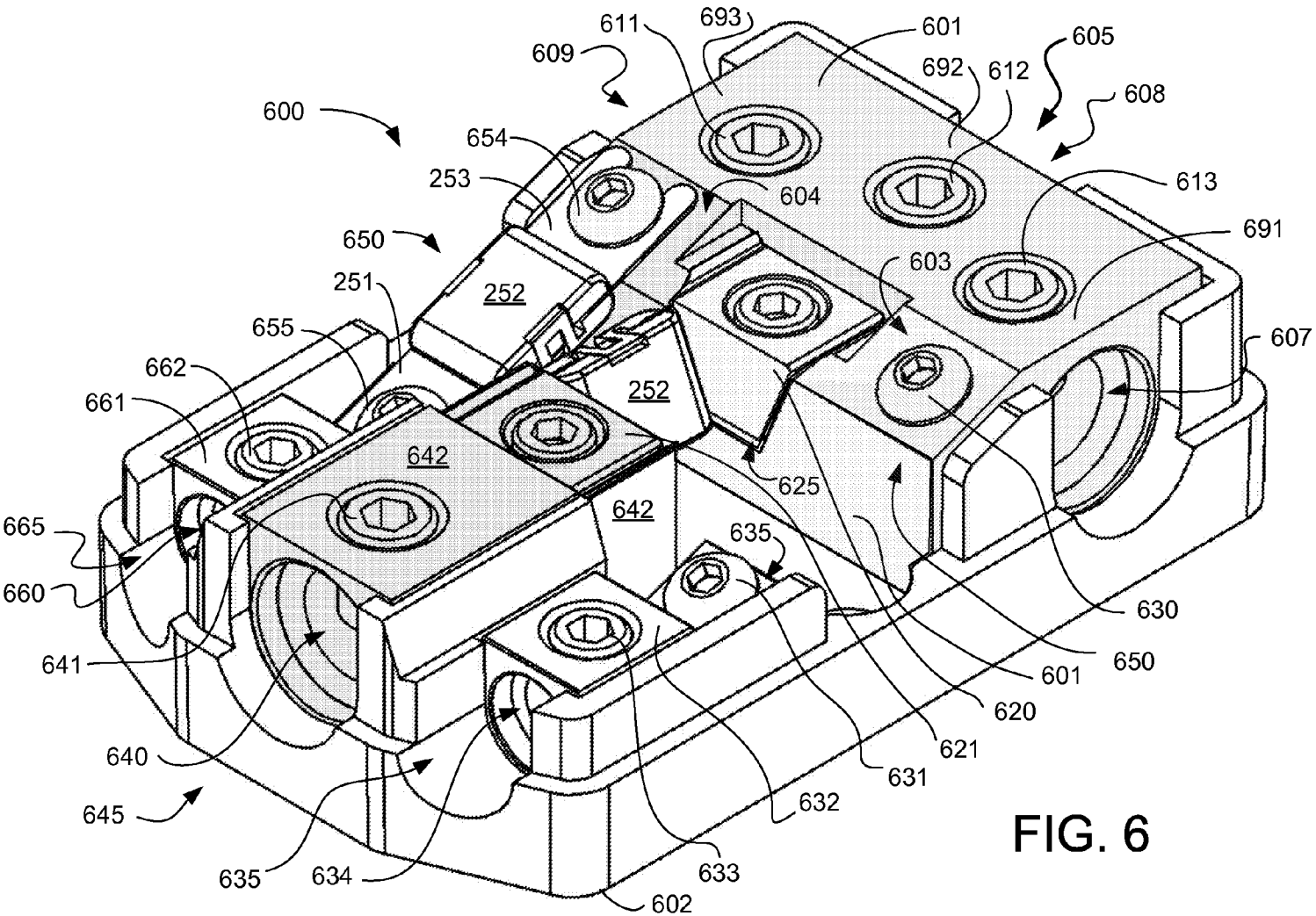
FIG. 6 is a top perspective view illustrating a third exemplary embodiment of the dual-clamp fuse block having one dual-clamp fuse holder and two single-fuse holders, with fuses shown installed on one side.

FIG. 6 is a top perspective view illustrating a third exemplary embodiment of the dual-clamp fuse block 600 having one pair of multi-fuse couplers and two single-fuse couplers, with fuses 250 shown installed on one side. Preferably, fuse block 100 comprises fuse block 600. Base 602 supports, at the output end (left, in the FIG. 6 view), one multi-fuse coupler 645 and two single fuse couplers 635 and 665. Multi-fuse coupler 645 includes terminal 642, clamp 621, bore 640 and securer 641. Single fuse clamp 635 includes terminal 632, clamping screw 631, bore 634 and securer 633. Bore 634 and securer 633 form a conductor coupler. Clamping screw 631 is operable to clamp one electrical contact 251 or 253 of a flat fuse 250 to a flat surface 635 of terminal 632. Single fuse clamp 665 includes terminal 661, clamping screw 655, bore 660 and securer 662. Bore 660 and securer 662 form a conductor coupler. Clamping screw 655 is operable to clamp a first electrical contact 251 of a flat fuse 250 to a flat surface (not visible in this view, but similar to flat surface 635).

Base 602 supports, at the input end (right, in the FIG. 6 view) multi-fuse coupler 605. Multi-fuse coupler 605 includes terminal 601 which includes an inverted trapezoidal cavity 625 and two inclined flat surfaces 603 and 604 sized to each engage one large surface of one electrical contact 251 or 253 of a flat fuse 250. Multi-fuse coupler 605 also includes clamp 620, clamping screw 630 and clamping screw 654. Clamping screw 654 is operable to clamp second electrical contact 253 of flat fuse 250 to flat surface 604, as shown. Clamping screw 630 is operable to clamp first or second electrical contact 253 or 251 of a flat fuse 250 to flat surface 603.

Multi-fuse coupler 605 also includes multiple electrical conductor couplers. Bore 607 extends into terminal 601 and intersects securer 613 to form conductor coupler 691. A second bore, located at 608 but not visible in this view, extends into terminal 601 to intersect securer 612 to form conductor coupler 692. A third bore, located at 609 but not visible in this view, extends into terminal 601 to intersect securer 611 to form conductor coupler 693. The three conductor couplers 691-693 provide choices for routing a single input conductor to the dual-clamp fuse block 600 and for routing a continuation of the input line outbound in one of two remaining directions.

Base 602 is sized, shaped, and arranged to receive a cover (not shown) similar in properties to cover 400 but sized, shaped, and arranged to releasably snap-fit to dual-clamp fuse block 600. Dual-clamp fuse block 600 illustrates that dual-clamp fuse blocks may incorporate single-fuse couplers as well as multi-fuse couplers and that a single input multi-fuse coupler may supply both types of fuse couplers from a single source.

Figure 7A:
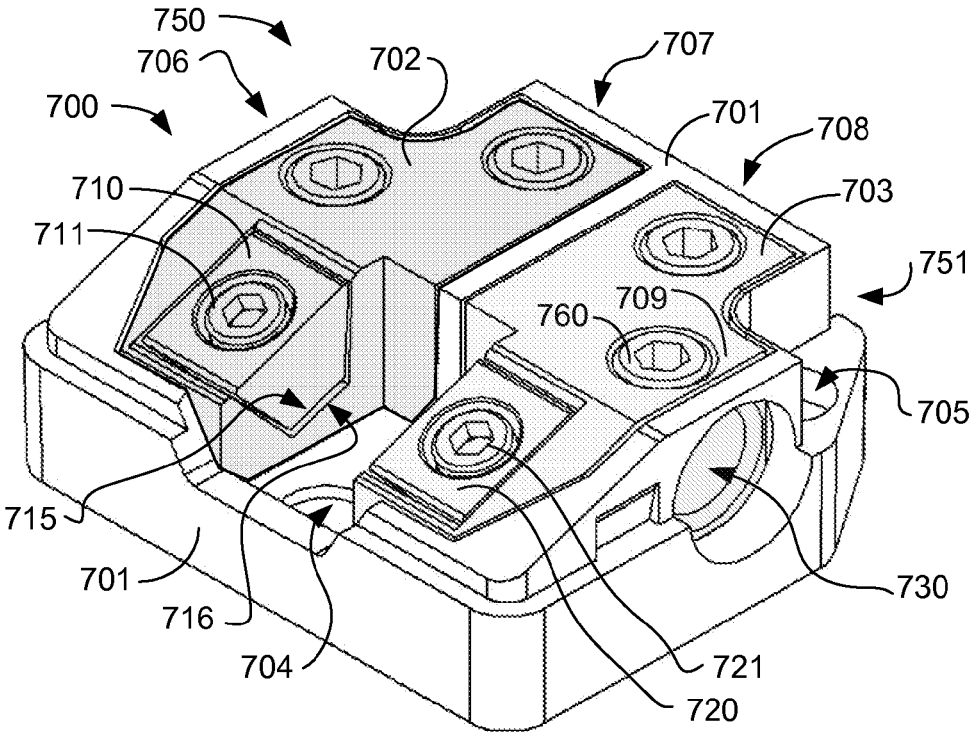
FIG. 7A is a top-front perspective view illustrating a fourth exemplary embodiment of the dual-clamp fuse block.

FIG. 7A is a top-front perspective view illustrating a fourth exemplary embodiment of the dual-clamp fuse block 700. Preferably, fuse block 100 comprises fuse block 700. Base 701 supports multi-fuse couplers 750 and 751 in a fixed, spaced-apart, insulated, and aligned relationship. Multi-fuse coupler 750 includes terminal 702, clamp 710, and conductor couplers 706 and 707. Multi-fuse coupler 751 includes terminal 703, clamp 720, and conductor couplers 708 and 709. Conductor coupler 709 includes bore 730 in terminal 703 and securer 760. Clamp 710 is oriented at an inclination relative to the horizontal plane of the bottom of the base 701. Because the clamps 710 and 720, like clamps 160 and 161, uses opposing urging mechanisms 711 and 721 and biasing mechanisms (not visible in this view), the clamps 710 and 720 has no preferred orientation from a mechanical perspective, and so can be oriented to maximize ease of use for the user. Regardless of the orientation, block bottom surface 715 and cavity bottom surface 716 preferably remain parallel, as shown. Countersunk bores 704 and 705 may receive mounting hardware for mounting base 701 to an environmental surface of any orientation.

Figure 7B:
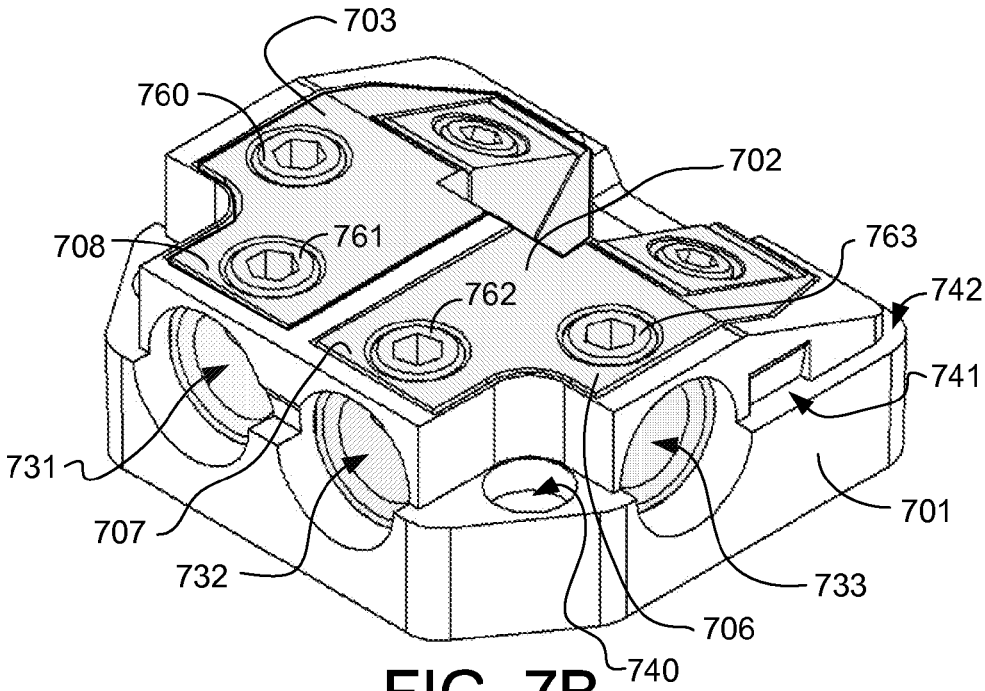
FIG. 7B is a top-rear perspective view illustrating the fourth exemplary embodiment of the dual-clamp fuse block of FIG. 7A.

FIG. 7B is a top-rear perspective view illustrating the fourth exemplary embodiment of the dual-clamp fuse block 700 of FIG. 7A. Conductor coupler 708 includes bore 731 in terminal 703 and securer 761. Conductor coupler 707 includes bore 732 in terminal 702 and securer 762. Conductor coupler 706 includes bore 733 in terminal 702 and securer 763. Securers 760, 761, 762, and 763 are preferably set screws, as shown. Base 701 has one or more detents 741 and a rim 742 for receiving a cover 790 (see FIG. 7C). Countersunk bore 740 may be used to secure base 701 to an environmental surface with a screw or other fastener. In this embodiment, each multi-fuse coupler 750 and 751 has two conductor couplers (706 and 707; and 708 and 709, respectively) with various spatial orientations relative to the base 701. While conductor couplers 706 and 707 are illustrated as being at right angles, the present invention is not so limited. Any of various orientations in three spatial dimensions, including vertical, may be used.

Figure 7C:
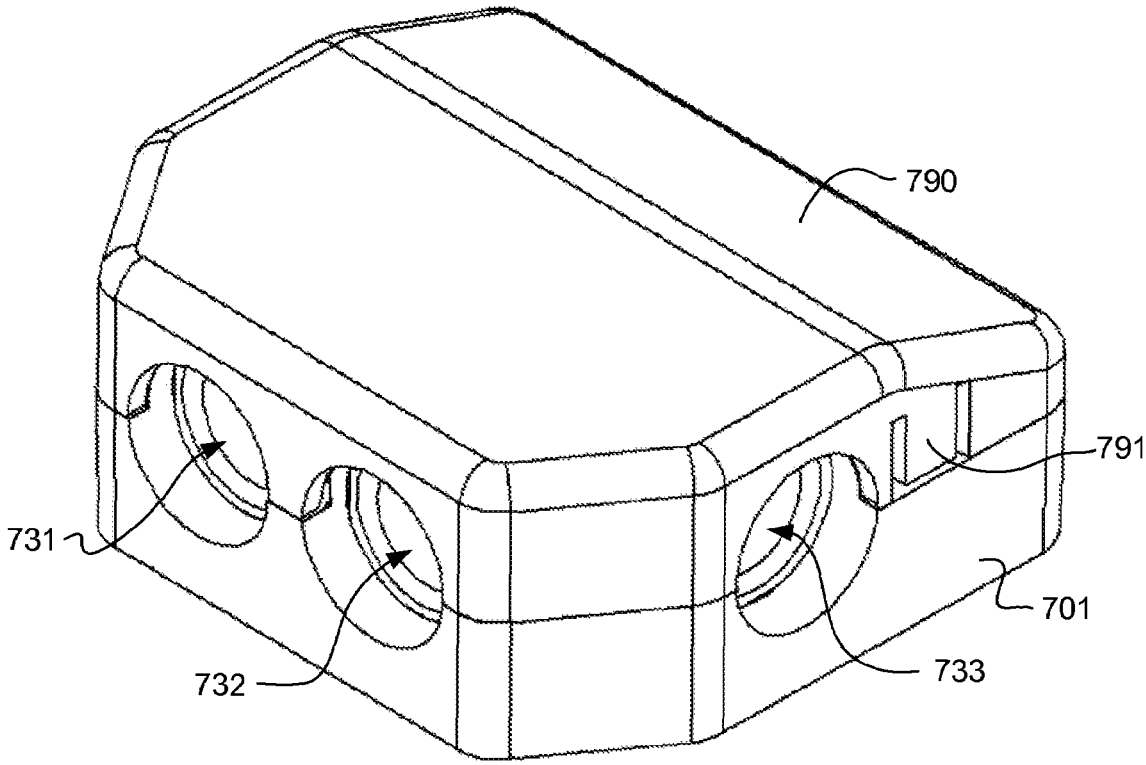
FIG. 7C is a top-rear perspective view illustrating the fourth exemplary embodiment of the dual-clamp fuse block of FIG. 7A with the cover in place.

FIG. 7C is a top-rear perspective view illustrating the fourth exemplary embodiment of the dual-clamp fuse block 700 of FIG. 7A with the cover 790 in place. Base 701 receives cover 790 along rim 742. Resilient tab 791 releasably snap-fits into detent 741. Cover 790 has similar properties to cover 400, discussed above, but cover 790 is sized, shaped, and arranged to fit dual-clamp fuse block 700. While releasable, manually operated, snap-fit cover 790 is preferred, some applications may require greater degree of strength in the coupler of the cover 790 to the dual-clamp fuse block 700. In some alternate embodiments, other approaches to coupler the cover 790 to dual-clamp fuse block 700, as are known in the art, may be used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. For example, the blocks of clamps 160 and 161 may be joined by an insulating member which has a bore to receive urging mechanism 114 and a bottom surface to engage a biasing mechanism 120, enabling clamps 160 and 161 to be operated with a single urging mechanism 114. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A fuse block, comprising:

a. at least one multi-fuse coupler operable to make secure electrical and mechanical coupling with one electrical contact of each of a plurality of fuses in a single operation; and b. at least one base sized, shaped, and arranged to maintain at least two said multi-fuse couplers in opposing, aligned, spaced-apart relationship.

2. The fuse block of claim 1, further comprising at least one conductor coupler operable to couple at least one electrical conductor to each multi-fuse coupler of said at least one multi-fuse coupler.

3. The fuse block of claim 2, further comprising at least one single-fuse coupler.

4. The fuse block of claim 2, wherein said at least one multi-fuse coupler comprises at least one plurality of multi-fuse couplers, further comprising one coupler to first electrical contacts of such plurality of fuses and comprising a plurality of couplers to second electrical contacts of such plurality of fuses.

5. The fuse block of claim 4, further comprising at least one single-fuse coupler.

6. The fuse block of claim 4, wherein said at least one plurality of multi-fuse couplers comprises multi-fuse couplers further comprising a plurality of electrical conductor couplers arranged in various fixed spatial orientations relative to said at least one base.

7. A fuse block capable of receiving a first fuse and a second fuse in an electrically parallel configuration relative to at least two electrical conductors, each fuse having first and second electrical contacts, the fuse block comprising:

a. at least one pair of opposing, aligned, and spaced apart electrically conductive terminals, b. wherein each said terminal of said at least one pair of opposing, aligned, and spaced apart electrically conductive terminals comprises a proximal end and a distal end;

c. at least one cavity in said at least one proximal end of each said terminal, d. wherein said at least one cavity comprises at least one first sidewall and at least one second sidewall, each said sidewall of said at least one first sidewall and at least one second sidewall comprising at least one bottom edge and at least one top edge;

e. at least one clamp, each said clamp of said at least one clamp operable, in a single operation, to urge one of the first contact and the second contact of the first fuse into abutment with said first sidewall and to urge one of the first contact and the second contact of the second fuse into abutment with said second sidewall.

8. The fuse block of claim 7, wherein said first and second sidewalls are inclined relative to each other.

9. The fuse block of claim 8, wherein said clamp comprises:

a. at least one block having at least one first side surface with substantially the same inclination as the first sidewall and at least one second side surface with substantially the same inclination as the second sidewall, b. wherein said at least one block is sized, shaped, and arranged to maintain said first side surface parallel and proximal to said first sidewall and is biased to create at least one first gap between said first side surface and said first sidewall, and c. wherein said at least one block is sized, shaped, and arranged to maintain said second side surface parallel and proximal to said second sidewall and is biased to create at least one second gap between said second side surface and said second sidewall;

d. at least one biasing member operable to bias said at least one block to maintain said at least one first gap large enough to receive one of the first contact and the second contact of the first fuse and to maintain said at least one second gap large enough to receive one of the first contact and the second contact of the second fuse; and e. at least one urging mechanism operable to oppose said at least one biasing member to reduce both said first gap and said second gap in a single operation.

10. The fuse block of claim 7, wherein each said terminal of said at least one pair of opposing, aligned, and spaced apart terminals comprises at least one electrical conductor coupler operable to electrically couple at least one electrical conductor to each said terminal.

11. The fuse block of claim 10, wherein said at least one electrical conductor coupler is positioned at said distal end of each said terminal.

12. The fuse block of claim 10, wherein said at least one electrical conductor coupler comprises a plurality of electrical conductor couplers having various spatial orientations, each sized, shaped, and arranged to couple at least one electrical conductor to at least one terminal of said at least one pair of opposing, aligned, and spaced apart terminals.

13. The fuse block of claim 7, further comprising at least one base operable to support said at least one pair of opposing, aligned, and spaced apart electrically conductive terminals in opposing, aligned, and spaced-apart relationship.

14. The fuse block of claim 13, further comprising at least one releasable cover sized, shaped, and arranged to assist in protecting said at least one pair of opposing, aligned, and spaced-apart electrically conductive terminals from environmental influences.

15. The fuse block of claim 14, wherein said at least one releasable cover is further sized, shaped, and arranged to releasably snap-fit to said at least one base.

16. The fuse block of claim 13, wherein said at least one base further comprises at least one support for at least one single-fuse coupler.

17. A fuse block capable of receiving a first fuse and a second fuse in an electrically parallel configuration relative to at least two electrical conductors, each fuse having first and second electrical contacts, the fuse block comprising:

a. at least one pair of opposing, aligned, and spaced apart electrically conductive terminals, wherein i. each said terminal of said at least one pair of opposing, aligned, and spaced apart electrically conductive terminals comprises at least one proximal end and at least one distal end, and ii. each said terminal of said at least one pair of opposing, aligned, and spaced apart electrically conductive terminals comprises at least one electrical conductor coupler positioned proximal to said at least one distal end, b. at least one inverted trapezoidal cavity in each said proximal end of each said each terminal, wherein i. each inverted trapezoidal cavity of said at least one inverted trapezoidal cavity comprises at least one bottom wall comprising at least one cavity bottom surface, at least one first inclined sidewall, at least one second inclined sidewall, and first angles of equal magnitude between said at least one cavity bottom surface and said at least one first and at least one second inclined sidewalls, and ii. said bottom wall comprises at least one first threaded bore therein;

c. at least one inverted trapezoidal block, having a bottom surface, a first side surface, and a second side surface, and second angles of equal magnitude between said at least one bottom surface and said at least one first and at least one second side surfaces, wherein i. said first angles and said second angles are congruent;

ii. said at least one inverted trapezoidal block is sized and arranged to fit within said at least one inverted trapezoidal cavity; and iii. said at least one inverted trapezoidal block comprises a second bore there through that is alignable to said first threaded bore; and d. at least one screw sized, shaped, and arranged to pass through said second bore and into said first threaded bore to urge said at least one inverted trapezoidal block toward said cavity bottom surface of said inverted trapezoidal cavity.

18. The fuse block according to claim 17, further comprising at least one spring, positioned between said at least one cavity bottom surface of said inverted trapezoidal cavity and said at least one bottom surface of said inverted trapezoidal block and operable to bias said inverted trapezoidal block toward a position allowing insertion of the first electrical contacts of the fuses between said first and second inclined side surfaces of said inverted trapezoidal block and said first and second inclined sidewalls of said inverted trapezoidal cavity, respectively.

19. The fuse block according to claim 17, wherein said at least one electrical conductor coupler comprises a plurality of electrical conductor couplers at various spatial orientations.

20. The fuse block according to claim 17, further comprising at least one single-fuse coupler.

* * * * *